US005419556A

United States Patent [19]

Take

[11] Patent Number: 5,419,556

[45] Date of Patent: May 30, 1995

[54] GOLF CLUB HEAD

[75] Inventor: Shigeki Take, Tokyo, Japan

[73] Assignee: Daiwa Golf Co., Ltd., Tokyo, Japan

[21] Appl. No.: 132,895

[22] Filed: Oct. 7, 1993

[30] Foreign Application Priority Data

Oct. 28, 1992 [JP] Japan ..... 4-080707 U

[51] Int. Cl.[6] ..... A63B 53/04

[52] U.S. Cl. ..... 273/167 A; 273/167 E

[58] Field of Search ..... 273/167 R, 164.1, 167 A, 273/167 E, 167 H, 167 F, 169, 175, 174, 193 R, 194 R, 167 D; D21/220

[56] References Cited

U.S. PATENT DOCUMENTS 3,068,011 12/1962 Sano ..... 273/174
3,761,095 9/1973 Thompson ..... 273/167 A X
3,810,631 5/1974 Braly .
3,961,796 6/1976 Thompson ..... 273/167 A
3,997,170 12/1976 Goldberg ..... 273/167 E X
4,173,343 11/1979 Richilano ..... 273/167 A X
4,325,550 4/1982 Thompson ..... 273/167 A X
5,240,252 8/1993 Schmidt ..... 273/167 A
5,271,622 12/1993 Rogerson ..... 273/167 E

FOREIGN PATENT DOCUMENTS 51-88356 7/1976 Japan .
253394 6/1926 United Kingdom ..... 273/174

*Primary Examiner*—Sebastiano Passaniti
*Attorney, Agent, or Firm*—Longacre & White

[57] ABSTRACT

In A golf club head, a central portion of a sole surface existing substantially centrally between the toe and heel sides is left as it is, two recesses are formed on the toe and heel sides, and the wall surfaces of the recesses are formed so as to be inclined gently from the sole surface central portion. The golf club head can cut into the ground properly when hitting a ball and also allows a golfer to hook or slice the ball freely.

9 Claims, 2 Drawing Sheets

GOLF CLUB HEAD

BACKGROUND OF THE INVENTION

The present invention relates to a golf club head, and in particular to an arrangement for a sole of the golf club head.

Conventionally, a pitching wedge or a sand wedge has a sole surface which forms only a simple uniform surface and, therefore, when hitting a golf ball, the pitching or sand wedge may bounce up on the ground or cannot strike properly deep into the sands, that is, such pitching or sand wedge may top the ball and thus it is difficult to control the ball by use of such conventional pitching or sand wedge.

To solve the above problems, there has been proposed a golf club head the sole surface of which has such a shape as disclosed in U.S. Patent publication No. 3,810,631, that is, in the sole surface thereof, there is formed a recess which extends along the longitudinal direction thereof from the toe side to the heel side thereof. However, the golf club head having this shape, in contrast to the previously described golf club head, tends to hit too deep into the ground or into the sands, which also makes it difficult to control the ball.

In view of the above circumstances, in Japanese Utility Model Publication No. 51-88356 of Showa, there is disclosed a golf club head in which there are formed recesses respectively in the two sides of the sole surface of the golf club head with the substantially central portion thereof excluded, in order to prevent the golf club head from bouncing up on the ground or entering deeply into the ground when hitting a golf ball. That is, the contact area of the sole surface of the golf club head is reduced to thereby prevent the golf club head from bouncing up on the ground and at the same time the central portion of the sole surface is left as it is to thereby prevent the golf club head from striking too deeply into the ground.

Each of the recesses formed in the sole surface of the golf club head disclosed in the above-mentioned Japanese Utility Model Publication has a semi-circular section and, the two recesses include on their respective sole surface central portion sides wall surfaces which are formed so as to extend in mutually opposed directions toward the toe and heel portions. This prevents the golf club head from moving in the toe or heel direction when hitting a golf ball, so that a golfer using this golf club is able to strike the ball straight.

However, an advanced golf player, according to conditions, must use properly a straight ball, a hook ball, and a slice ball intentionally. The above-mentioned wall surfaces receive resistance from the ground, which resistance provides an obstacle to the proper use of various ways of ball hitting.

SUMMARY OF THE INVENTION

Accordingly, it is an object of the invention to provide a golf club head which can strike a proper depth into the ground and also which allows a golfer to be free to select the proper one from various ways of ball hitting such as hooking, slicing and the like.

In attaining the above object, according to the invention, there is provided a golf club head in which substantially the central portion of a sole surface of the golf club head existing between the toe and heel portions thereof is left as it is, recesses are formed respectively on the toe and heel sides of the sole surface central portion, and the wall surfaces of the respective recesses are formed so as to be inclined gently from the sole surface central portion.

According to the present golf club head, since the recesses are formed in the other portions of the sole surface than the sole surface central portion, when hitting a ball, a suitable degree of hitting into the ground can be realized and, because the wall surfaces of the respective recesses formed on the sole surface central portion sides thereof are inclined gently, the golf club head receives little resistance from the ground when hooking or slicing the ball.

DETAILED DESCRIPTION OF THE PREFERRED EMBODIMENTS

Figure 1:
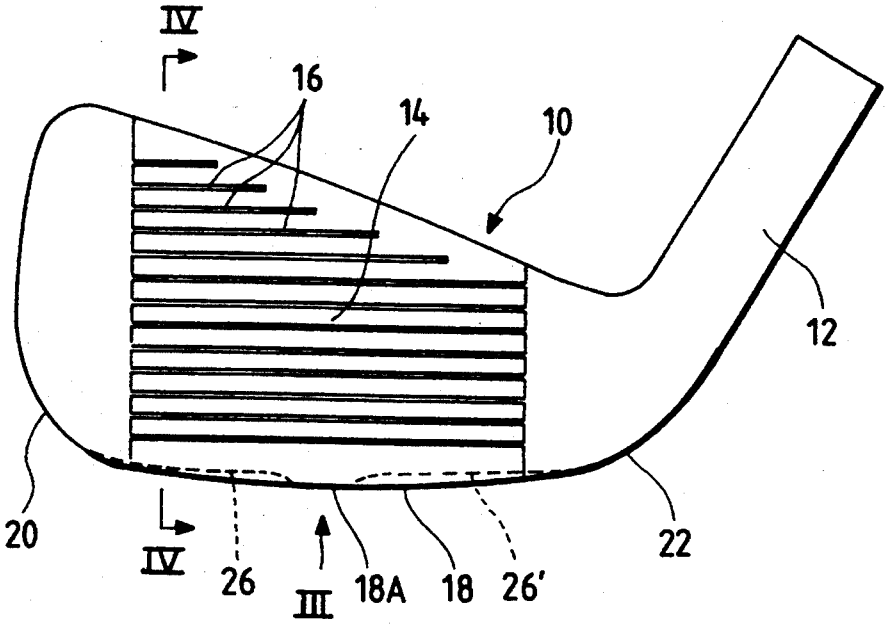
FIG. 1 is a side view of a golf club head according to the invention.

Description will be given below in more detail of the invention by way of an embodiment thereof shown in the accompanying drawings.

A golf club head 10 includes a face surface 14 existing in front of a hosel 12 to be connected to a shaft main body and having a ball hitting point, and a sole surface 18 disposed below the face surface 14 to be contacted with the ground. The golf club head 10 further includes a back surface 24 which is disposed at the back of the face surface 14 and continues from the sole surface 18. The face surface 14 includes a plurality of score lines 16 which are used to cause spin on a ball when hitting the ball.

Figure 3:
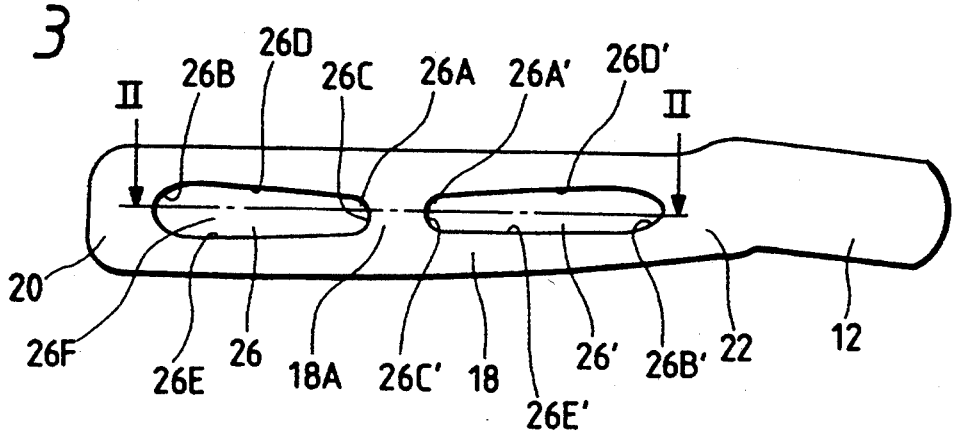
FIG. 3 is a bottom view of the golf club head shown in FIG. 1, taken along the arrow line III shown in FIG. 1.

In FIG. 1, a reference numeral 20 designates a toe portion of the golf club head 10, and 22 stands for a heel portion thereof. As shown in FIG. 3, the sole surface 18 defines a central portion 18A left as it is, and two elongated recesses 26, 26' which extend longitudinally from the central portion 18A toward respective one of the toe portion 20 and heel portion 22. The central portion 18A of the sole surface 18 (which will be hereinafter referred to as a sole surface central potion 18A as well) situated just below a sweet spot S thereof and situated substantially centrally between the toe portion 20 and heel portion 22

Figure 2:
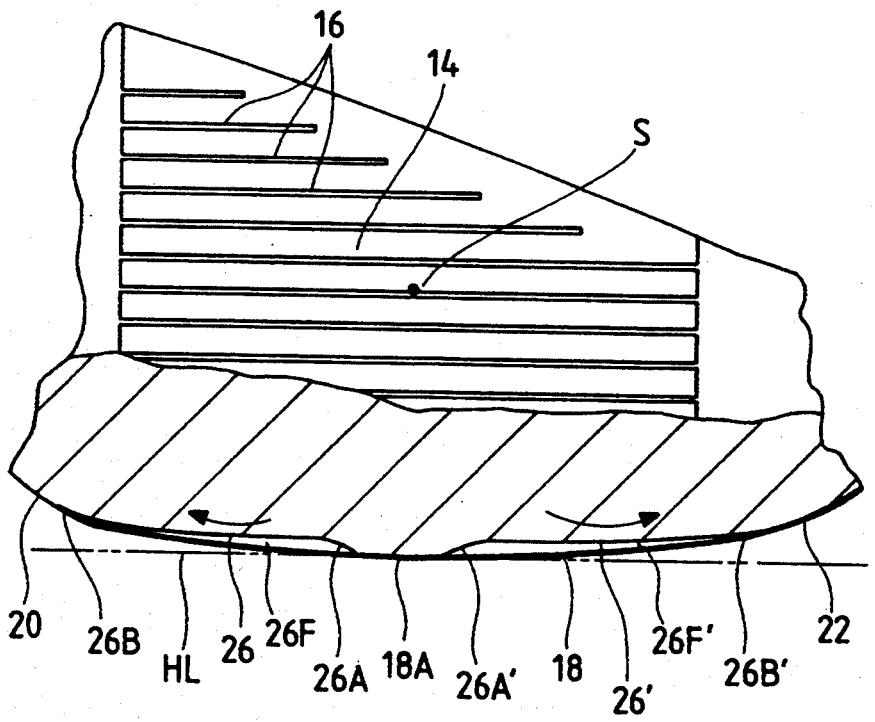
FIG. 2 is an enlarged partial longitudinal section view of part of the golf club head shown in FIG. 1, taken along the arrow line II—II shown in FIG. 3.

A longitudinal section view of the recesses 26, 26' is enlargedly shown in FIG. 2. The recess 26 formed between the toe portion 22 and the sole surface central portion 18A includes a wall surface 26A which merges into the sole surface central portion 18A and defines a curved boundary 26C between the recess 26 and the central portion 18A. The wall surface 26A of the recess 26 does not change suddenly but is inclined gently with respect to the sole surface central portion 18A. Also, the other recess 26' formed between the heel portion 22 and the central portion 18A includes a wall surface 26A' which merges into the sole surface central portion 18A and defines a curved boundary 26C' between the recess 26′ and the central portion 18A. Similarly, the wall surface 26A′ of the recess 26′ is inclined gently.

Figure 4:
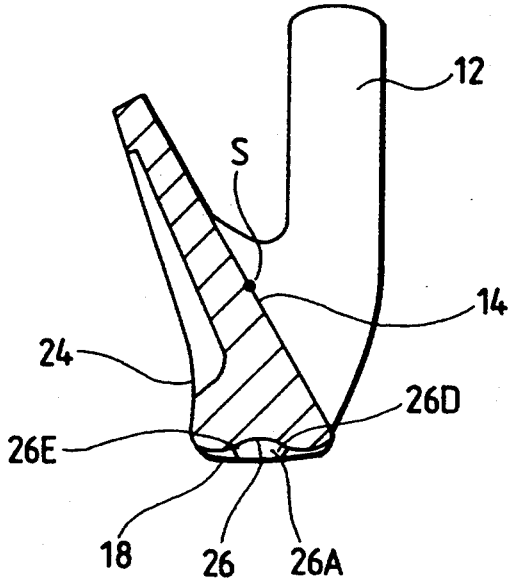
FIG. 4 is a transverse section view taken along the arrow line IV—IV shown in FIG. 1; and, FIG. 5 is an explanatory view of the invention.

Also, in the present invention, not only the wall surfaces 26A and 26A′ but also the wall surfaces 26B and 26B′ of the recesses 26, which respectively merge into the toe portion 20 and heel portion 22, are also inclined gently and continue smoothly to the toe and heel surfaces, respectively. Further, as shown in FIG. 4, the longer side wall surfaces 26D and 26E (26D′ and 26E′) extending in the right and left direction in FIG. 3 are also gently inclined and connected with the sole surface 18. In this embodiment, a bottom 26F (26F′) circumscribed by the wall surfaces 26A, 26B, 26D and 26E (26A′, 26B′ 26D′ and 26E′) is formed into a convex surface as emphasized by arrows in FIG. 2.

Figure 5:
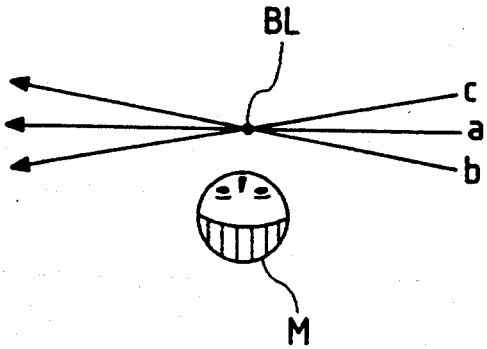

In FIG. 5, there are shown a direction a in which a golfer M hits a ball BL straight, a direction b in which the golfer M hooks the ball BL, and a direction c in which the golfer M slices the ball BL. The problem that is found in the conventional golf club head is a steep wall surface extending perpendicularly to a line which connects the toe and heel portions of the golf club head and provides resistance to a motion component in a back-and-forth direction (in FIG. 5, a direction extending perpendicularly to the direction a) in the case of the direction b or c. However, according to the golf club head 10 of the invention, since the wall surfaces 26A, 26A′, 26B and 26B′ are all inclined gently, they will never provide any resistance to the motion component in the above-mentioned back-and-forth direction. Further, the curved boundaries 26C and 26C′ allows a golfer to strike a ball in a desired way. Therefore, the golfer can hook or slice the ball easily with the golf club head 10.

In the illustrated embodiment, although the wall surfaces 26A, 26A′, 26B and 26B′ are all inclined gently, as shown in FIG. 2, it is not always essential to the present invention that the two wall surfaces 26B and 26B′ are inclined gently since the wall surfaces 26B and 26B′ are deviated from a plane HL including the sole surface central portion 18A so as not to receive large resistance from the ground. But, when the sole surface 18 coincides substantially with the above-mentioned plane HL, it is preferable that these wall surfaces 26B and 26B′ are inclined gently. However, in this case as well, even when the wall surfaces 26B and 26B′ are not always inclined gently, the centrally situated wall surfaces 26A and 26A′, which are inclined gently, can reduce the ground resistance to a great extent.

As has been described heretofore, according to the invention, there is provided an improved golf club head in which there are formed the two recesses respectively on the two sides of the sole surface central portion of the golf head club and the wall surfaces of the two recesses respectively continuing with the sole surface central portion of the golf club head are inclined gently. Due to this, when hitting a ball, the present golf club head is able to cut into the ground properly and at the same time the golf club head allows the golfer to hook or slice the ball freely. Further, the curved boundaries between the central portion and each of the recesses allows the golfer to easily strike a ball in a desired way selected from hooking, slicing, and so on. Furthermore, the convex bottom configuration of each recess contributes to preventing the golf club head from entering too deeply into the ground when hitting a ball.

What is claimed is:

1. A golf club head having a sole portion defining a sole surface extending longitudinally between a toe portion and a heel portion, comprising an improvement wherein said sole portion defines a central portion flush with said sole surface, and one of a pair of longitudinally elongated recesses extends from said central portion toward each of said toe portion and said heel portion, and each of said recesses includes a wall surface which is inclined toward said central portion.

2. The golf club head according to claim 1, wherein said central portion and each of said recesses defines a curved boundary.

3. A golf club head having a sole portion defining a sole surface located between a toe portion and a heel portion, comprising an improvement wherein said sole portion defines a central portion flush with said sole surface, and a pair of recesses extending from said central portion toward a respective one of said toe portion and said heel portion, and each of said recesses includes a wall surface which is inclined toward said central portion, said recesses being elongated from said central portion toward said respective one of said toe portion and said heel portion, wherein said central portion is located just below a sweet spot.

4. A golf club head having a sole portion defining a sole surface located between a toe portion and a heel portion, comprising an improvement wherein said sole portion defines a central portion flush with said sole surface, and a pair of recesses extending from said central portion toward a respective one of said toe portion and said heel portion, and each of said recesses includes a wall surface which is inclined toward said central portion, said recesses being elongated from said central portion toward said respective one of said toe portion and said heel portion, wherein each of said recesses smoothly merges into a respective one of said toe portion and heel portion.

5. A golf club head having a sole portion defining a sole surface located between a toe portion and a heel portion, comprising an improvement wherein said sole portion defines a central portion flush with said sole surface, and a pair of recesses extending from said central portion toward a respective one of said toe portion and said heel portion, and each of said recesses includes a wall surface which is inclined toward said central portion, said recesses being elongated from said central portion toward said respective one of said toe portion and said heel portion, wherein each of said recesses has a bottom having a portion located near said central portion, said portion being larger in depth than other portions of said bottom.

6. A golf club head having a sole portion defining a sole surface located between a toe portion and a heel portion, comprising an improvement wherein said sole portion defines a central portion flush with said sole surface, and a pair of recesses extending from said central portion toward a respective one of said toe portion and said heel portion, and each of said recesses includes a wall surface which is inclined toward said central portion, said recesses being elongated from said central portion toward said respective one of said toe portion and said heel portion, wherein each of said recesses has wall surfaces circumscribing a bottom of said recess, all wall surfaces merging smoothly into said sole surface.

7. The golf club head according to claim 6, wherein said bottom is convex.

8. A golf club head having a sole portion defining a convex sole surface located between a toe portion and a heel portion, comprising an improvement wherein said sole portion defines a central portion flush with said sole surface, and a pair of recesses extending from said central portion toward a respective one of said toe portion and said heel portion, and said central portion and each of said recesses has a common curved boundary therebetween, each of said recesses defining a convex bottom surface extending in a direction from said central portion toward said respective one of said toe and heel portions.

9. The golf club head according to claim 8, wherein said curved boundary is located on a plane substantially flush with said central portion.

* * * * *